US010458768B1

(12) United States Patent
Kim et al.

(10) Patent No.: US 10,458,768 B1
(45) Date of Patent: Oct. 29, 2019

(54) PROTECTION COVERING FOR FOLDED TAIL FIN OF PROJECTILE

(71) Applicant: AGENCY FOR DEFENSE DEVELOPMENT, Daejeon (KR)

(72) Inventors: Jin-Seok Kim, Daejeon (KR); Jae-Hyun Choi, Daejeon (KR); Byung-Duk Kang, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 16/416,087

(22) Filed: May 17, 2019

(30) Foreign Application Priority Data

May 18, 2018 (KR) ..... 10-2018-0057144

(51) Int. Cl.
*F42B 14/06* (2006.01)
*F42B 10/14* (2006.01)

(52) U.S. Cl.
CPC ..... *F42B 14/064* (2013.01); *F42B 10/14* (2013.01)

(58) Field of Classification Search
CPC ..... F42B 14/064; F42B 14/06; F42B 10/14; F42B 14/061; F42B 14/067; F42B 30/02; F42B 10/06; F42B 10/36; F42B 33/00; F42B 10/02; F42B 10/26; F42B 14/062; F42B 14/08; F42B 15/105
USPC ..... 102/520
See application file for complete search history.

(56) References Cited

U.S. PATENT DOCUMENTS 195,040 A * 9/1877 Owen ..... F42B 14/064 102/520
384,574 A * 6/1888 Hawley ..... F42B 14/064 102/520
1,368,057 A * 2/1921 Rooney ..... F42B 14/064 102/490
3,847,082 A * 11/1974 Feldmann ..... F42B 14/064 102/522
3,905,299 A * 9/1975 Feldmann ..... F42B 14/064 102/522
4,148,259 A * 4/1979 Yuhash ..... F42B 14/064 102/522
4,296,687 A * 10/1981 Garrett ..... F42B 14/064 102/518

(Continued)

FOREIGN PATENT DOCUMENTS

KR 1020100055472 A 5/2010
KR 1020180039430 A 4/2018

*Primary Examiner* — Joshua E Freeman
*Assistant Examiner* — Bridget A Cochran
(74) *Attorney, Agent, or Firm* — STIP Law Group, LLC

(57) ABSTRACT

A protection covering for folded tail fins of a projectile. The protection covering is installed to surround outer portion of the folded tail fins of the projectile and protects the tail fins against external high pressure, whereby the tail fins are not damaged even at high pressure generated in a launching process of the projectile. After the launch of the projectile, the protection covering is separated from the projectile by the pressure applied on the inner side surface of the circular plate portion of the protection covering by the accumulated combustion gas inside the air pocket. The protection covering is automatically separated from the projectile without providing any other mechanical structure immediately after the launch of the projectile, thereby providing an effect to allow the tail fins to be deployed quickly and economically.

9 Claims, 3 Drawing Sheets

(56) References Cited

U.S. PATENT DOCUMENTS 4,314,510 A * 2/1982 Jeter ..... F42B 14/064 102/521
4,488,491 A * 12/1984 Rhodes ..... F42B 14/064 102/501
4,539,911 A * 9/1985 Flatau ..... F02K 7/18 102/374
4,709,638 A * 12/1987 Broden ..... F42B 14/068 102/522
4,850,280 A * 7/1989 Wallow ..... F42B 14/064 102/522
6,105,506 A * 8/2000 Gangale ..... F42B 10/26 102/439
6,571,715 B1 * 6/2003 Bennett ..... F42B 10/38 102/374
6,829,997 B1 * 12/2004 Hilleman ..... F42B 14/064 102/522
7,226,016 B2 * 6/2007 Johnsson ..... F42B 10/16 244/3.28
7,935,208 B2 * 5/2011 Park ..... F42B 14/061 102/520
8,312,813 B2 * 11/2012 McDermott ..... F42B 10/44 102/473
2010/0000439 A1 * 1/2010 Baumann ..... F42B 5/18 102/521
2010/0077934 A1 * 4/2010 Heitmann ..... F42B 14/064 102/523
2010/0139518 A1 * 6/2010 Baumann ..... F42B 14/064 102/523
2010/0269725 A1 * 10/2010 Hall ..... F42B 14/02 102/520
2010/0276082 A1 * 11/2010 Park ..... F42B 14/061 156/276
2010/0276830 A1 * 11/2010 Park ..... F42B 14/061 264/103
2011/0023746 A1 * 2/2011 Hayat ..... F42B 14/067 102/520
2017/0268855 A1 * 9/2017 McAllister ..... F42B 10/64

* cited by examiner

PROTECTION COVERING FOR FOLDED TAIL FIN OF PROJECTILE

CROSS REFERENCE TO RELATED APPLICATION(S)

This application claims the benefit of Korean Patent Application No. 10-2018-0057144, filed May 18, 2018, which is hereby incorporated by reference in its entirety into this application.

BACKGROUND OF THE INVENTION

1. Technical Field

The present invention relates generally to a protection covering for folded tail fins of a projectile and, more particularly, to a protection covering for foldable tail fins of a projectile, which is installed to surround outer portion of the folded tail fins of the projectile and protects the tail fins against external high pressure, whereby the tail fins are not damaged even at high pressure generated in a launching process of the projectile. After the launch of the projectile, the protection covering of the present invention is automatically separated from the projectile without providing any other mechanical structure immediately, thereby providing an effect to allow the tail fins to be deployed quickly.

2. Description of the Related Art

In general, cannon-launched ammunition filled with a high-explosive has a problem of abnormal flight due to an unstable flight condition when there is no spin in a projectile and, therefore, to ensure the stability of the flight, the cannon-launched ammunition has been developed in a spin stabilization type that gives a high-speed spin to the flying projectile.

In recent years, cannon-launched ammunition with guidance and control function has been studied, and studies have been conducted to install tail fins on a rear part of a flying projectile to implement the guidance and control function while ensuring the stability of the flight in a state of no spin in a projectile.

When the projectile is fired, high-pressure thrust is generated by combustion of a propellant. In this case, there is a problem that the high propelling pressure directly affects the tail fins installed on the rear part of the projectile, thereby rupturing the tail fins.

SUMMARY OF THE INVENTION

Accordingly, the present invention has been made to solve the above-mentioned problems, and it is an object of the present invention to provide a protection covering for folded tail fins of a projectile which can prevent the tail fins from being broken or damaged even at high pressure generated in a launching process of the projectile by installing the protection covering to surround outer portion of the folded tail fins provided at the rear end of the projectile.

Another object of the present invention is to allow the protection covering to be automatically separated from the projectile immediately after launch of the projectile so that the tail fins can be deployed quickly.

In order to accomplish the above objectives, a protection covering for folded tail fins of a projectile of the present invention includes: a body portion having a cylindrical shape and having an inner part into which a portion of the projectile having tail fins installed thereat is inserted, whereby the tail fins is constrained; a circular plate portion provided at a rear end of the body portion to close the rear end of the body portion; a combustion gas suction hole provided at a center of the circular plate portion so as to be coaxial with the circular plate portion; and a plurality of inner grooves provided on an inner side surface of the circular plate portion and provided in a circumferential direction of the combustion gas suction hole.

The rear end of the projectile is configured to be open.

When the projectile is inserted into the body portion, the rear end of the projectile being open is closed by the circular plate portion, whereby the inner side of the rear end portion of the projectile becomes an air pocket.

The combustion gas generated during the launch of the projectile may flow into the inner side of an air pocket through the combustion gas suction hole.

After the launch of the projectile, the protection covering may be separated from the projectile by the pressure applied on the inner side surface of the circular plate portion by the accumulated combustion gas inside the air pocket, whereby a constraint of the tail fins is released.

When the projectile is inserted into the body portion, the rear end of the projectile is positioned in close contact with the inner surface of the circular plate.

The body portion includes a first end portion being a portion with a predetermined length from the rear end toward a front end of the body portion, a second end portion being a portion with a predetermined length from the first end portion toward the front end of the body portion, and a third end portion being a portion from the second end portion to the front end of the body portion.

An inner diameter of the body portion is constant within a range until reaching the third end portion starting from the first end portion of the body portion.

In the body portion, the third end portion is configured to have a greater thickness than the first end portion.

The second end portion is configured such that a thickness thereof is gradually increased as approaching toward the third end portion from the first end portion.

The inner grooves are configured in a symmetrical shape.

When the plurality of inner grooves is provided in the circular plate portion, angles between adjacent inner grooves are configured to be the same to each other.

Each of the inner grooves is an elliptical shape.

Accordingly, the present invention has an effect of preventing the tail fins from being broken or damaged even at high pressure generated in the launching process of the projectile.

In addition, the protection covering of the present invention is automatically separated from the projectile without providing any other mechanical structure immediately after the launch of the projectile, thereby providing an effect to allow the tail fins to be deployed quickly and economically.

DESCRIPTION OF THE PREFERRED EMBODIMENTS

Figure 1:
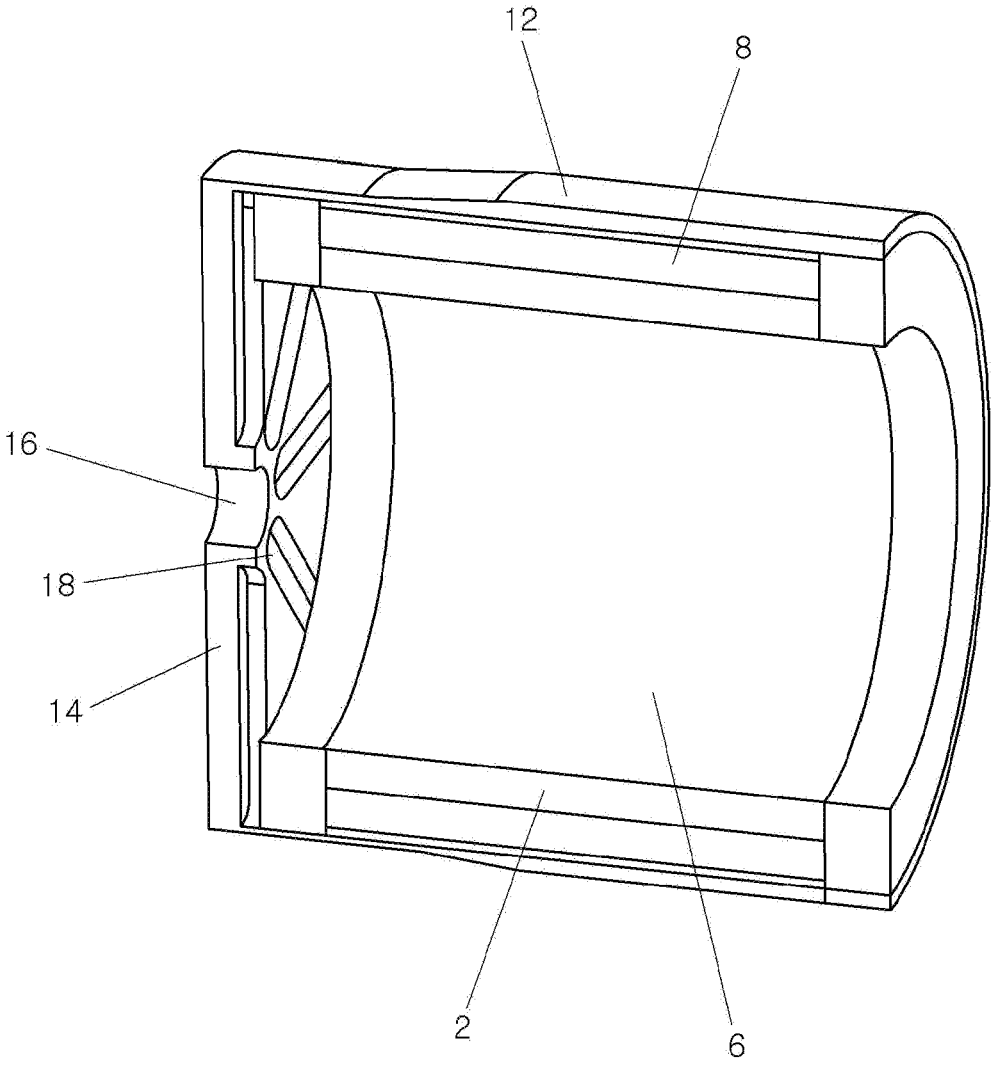
FIG. 1 is a partial cross-sectional view of tail fins of a projectile equipped with a protection covering of the present invention.

The above and other features and advantages of the present invention will become more apparent from the following detailed description of the present invention when taken in conjunction with the accompanying drawings, and it will be apparent to those skilled in the art that the present invention may be practiced without these specific details. As the present invention is capable of applying various modifications and having various forms, specific embodiments will be illustrated in the drawings and described in detail in the text. It is to be understood, however, that the invention is not intended to be limited to the particular forms disclosed, but on the contrary, is intended to cover all modifications, equivalents, and alternatives falling within the spirit and scope of the invention. The terms used herein is for the purpose of describing only particular embodiments and is not intended to be limiting of the invention.

Hereinafter, preferred embodiments of the present invention will be described in detail with reference to the accompanying drawings.

The present invention relates generally to a protection covering for folded tail fins of a projectile and, more particularly, to a protection covering for foldable tail fins of a projectile, which is installed to surround outer portion of the folded tail fins of the projectile and protects the tail fins against external high pressure, whereby the tail fins are not damaged even at high pressure generated in a launching process of the projectile.

Figure 2:
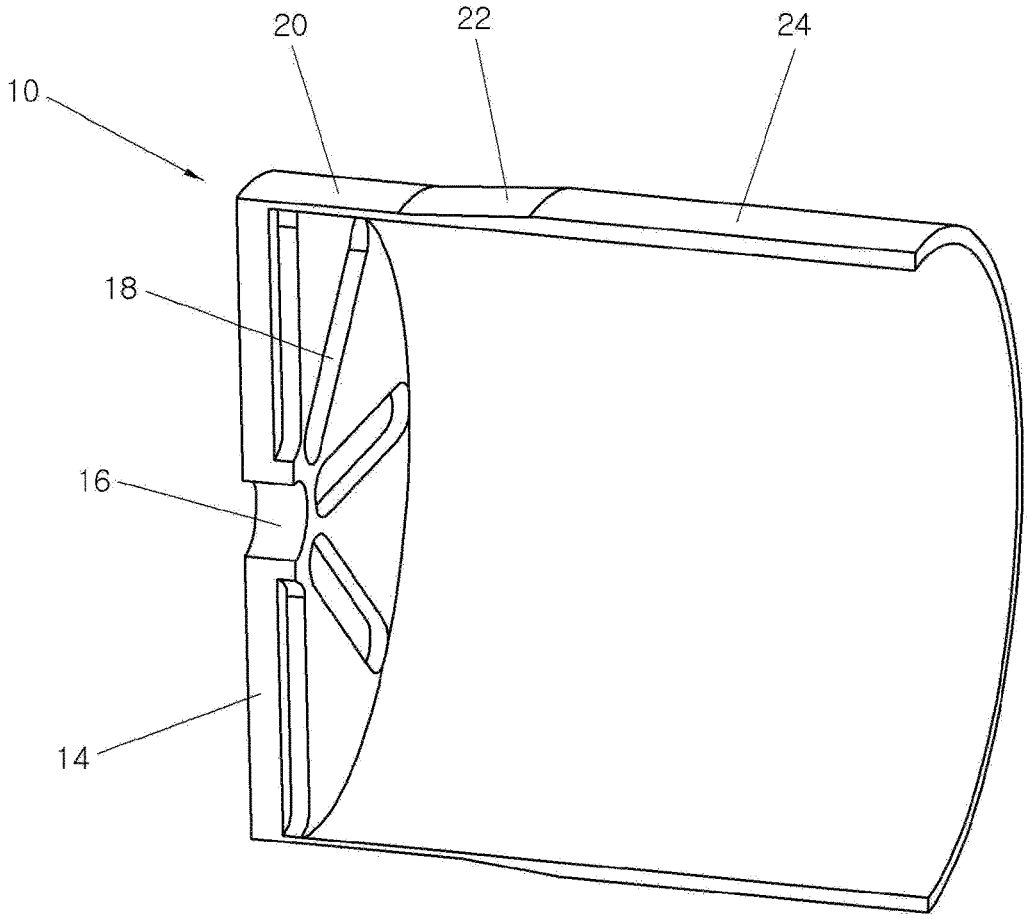
FIG. 2 is a cross-sectional view of the protection covering of the present invention.

FIG. 1 is a partial cross-sectional view of tail fins of a projectile equipped with a protection covering of the present invention and FIG. 2 is a cross-sectional view of the protection covering of the present invention.

The protection covering 10 of the present invention for protecting the folded tail fin 8 provided at a rear end of the projectile 2 such as a projectile includes: a body portion 12 having a cylindrical shape and having an inner part into which a portion of the projectile 2 having the tail fin 8 installed thereat is inserted, whereby the tail fin 8 is constrained; a circular plate portion 14 provided at a rear end of the body portion 12 to close the rear end of the body portion 12; a combustion gas suction hole 16 provided at a center of the circular plate portion 14 so as to be coaxial with the circular plate portion 14; and a plurality of inner grooves 18 provided on an inner side surface of the circular plate portion 14 and provided in a circumferential direction of the combustion gas suction hole 16.

That is, the protection covering 10 is a cup-like shape with an open front end, and a certain length of the rear end of the projectile 2 is inserted from the front end toward a rear end of the protection covering 10.

The projectile 2 is inserted into the inner part of the protection covering 10 in a state that the tail fin 8 is folded so as to surround the outer circumferential surface of the projectile 2, and when the rear end of the projectile 2 is inserted into the inner part of the protection covering 10, the tail fin 8 is completely inserted into the protection covering 10 and is in a constrained state.

When the projectile 2 is inserted into the body portion 12, the rear end of the projectile 2 is positioned in close contact with the inner surface of the circular plate 14, and a space corresponding to length, depth, and width of each of the inner grooves 18 is provided between the rear end of the projectile 2 and each inner groove 18 provided on the inner side surface of the circular plate portion 14 of the protection covering 10.

The body portion 12 is classified into a first end portion 20 being a portion with a predetermined length from the rear end toward the front end of the body portion 12, a second end portion 22 being a portion with a predetermined length from the first end portion 10 toward the front end of the body portion 12, and a third end portion 24 being a portion from the second end portion 22 to the front end of the body portion 12.

The inner diameter of the body portion 12 is configured to be constant within a range until reaching the third end portion 24 starting from the first end portion 20 of the body portion 12.

In the body portion 12, the third end portion 24 is configured to have a greater thickness than the first end portion 20, and the second end portion 22 is configured such that the thickness thereof is gradually increased as approaching toward the third end portion 24 from the first end portion 20.

The reason why the thickness of the body portion 12 is different for each longitudinal portion is because it is necessary to increase the structural strength while reducing the weight of the body portion to increase the velocity of the projectile 2. cannon-launched In addition, when the projectile 2 travels in a gun barrel during a launching process, the projectile 2 does not move uniformly along the center axis of the gun barrel but moves tilted from the central axis of the gun barrel while wobbling in the gun barrel. Accordingly, the tail portion of the projectile 2 comes in contact with the inner wall of the gun barrel, thereby causing interference therewith. In order to minimize such interference, the first end portion 20 is configured to have the thickness thinner than the third end portion 24.

A diameter of the combustion gas suction hole 16 may be adjusted according to intention of a manufacturer.

The rear end of the projectile 2 is configured open so that the rear end of the projectile 2 is closed by the circular plate portion 14 when the projectile 2 is inserted into the body portion 12. Accordingly, the empty space of the inner side of the rear end portion of the projectile 2 plays a role as an air pocket 6.

During the launch of the projectile 2, high propelling pressure is generated by the combustion of the propellant, and the combustion gas of the propellant generated at this time flows into the inner side of the air pocket 6 through the combustion gas suction hole 16.

Figure 3:
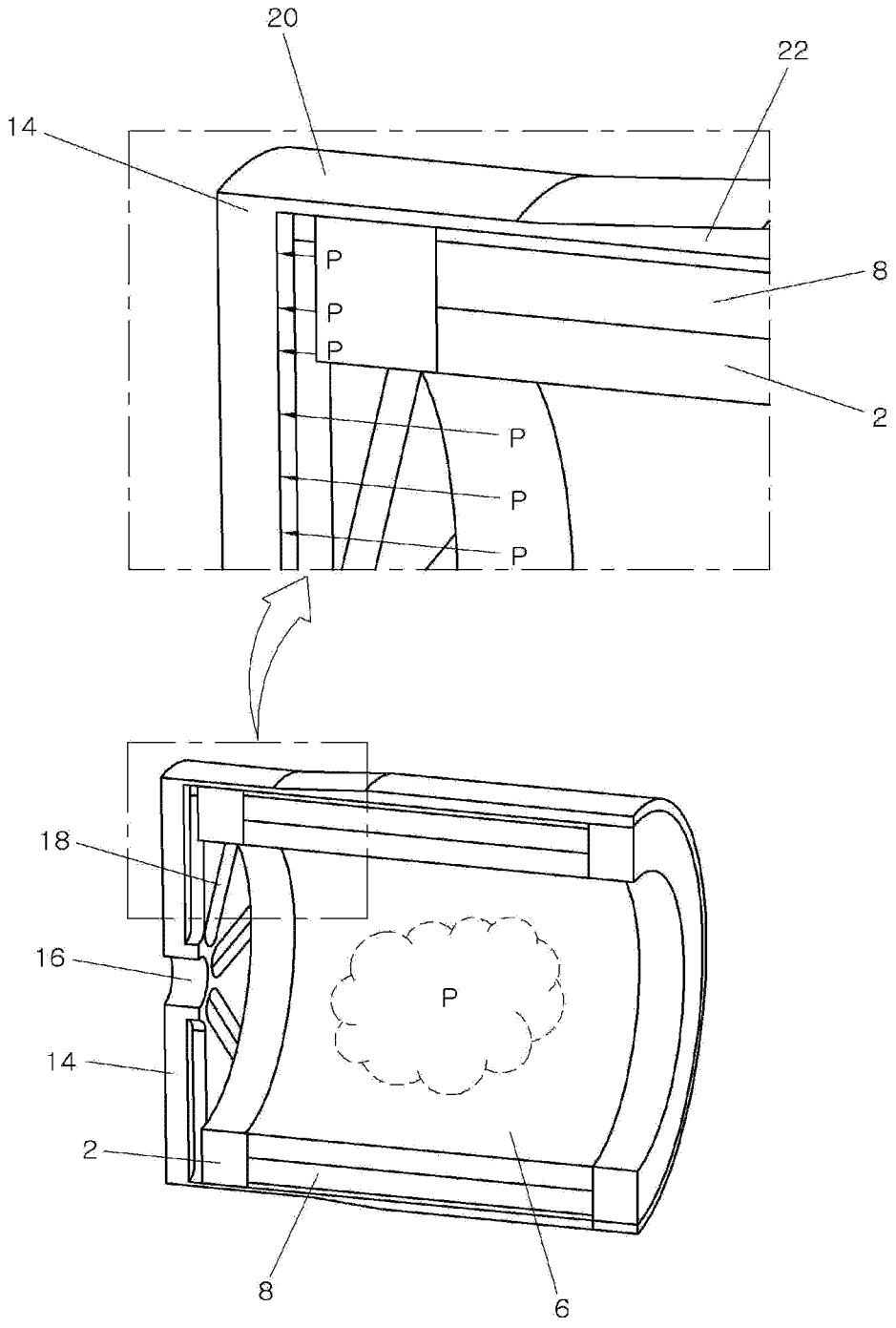
FIG. 3 is a conceptual view of operation of internal pressure of a projectile in a portion where the protection covering of the present invention is installed.

FIG. 3 is a conceptual view of operation of internal pressure of the projectile in a portion where the protection covering of the present invention is installed.

When the projectile 2 is in a state being inserted into the body portion 12 and is present inside the gun barrel, the applied force by pressure on the outer side surface of the circular plate portion 14 by the combustion gas of the propellant is kept in a state greater than the force by pressure on the inner side surface of the circular plate portion 14 inside the air pocket 6.

After the projectile 2 is fired and moves away from the gun barrel, the pressure by the combustion gas applied on the outer surface of the circular plate portion 14 does not exist, and only the pressure by the accumulated combustion gas inside the air pocket 6 applied on the inner side surface of the circular plate portion 14 exists.

Accordingly, after the launch of the projectile 2, the protection covering 10 is automatically separated from the projectile 2 by the pressure applied on the inner side surface of the circular plate portion 14 by the accumulated combustion gas inside the air pocket 6, whereby the constraint of the tail fin 8 is released.

Each of the inner grooves 18 plays a role to increase an area, of the inner side surface of the circular plate portion 14, on which the pressure of the accumulated combustion gas inside the air pocket 6 is applied so that the protection covering 10 may be separated from the projectile 2 within a short period of time after the projectile 2 moves away from the muzzle.

When a plurality of the inner grooves 18 is provided, an even number of inner grooves is generally provided, but in the case of an odd number, three grooves are generally provided.

The inner grooves 18 are configured in a symmetrical shape so that the pressure applied on the inner surface of the circular plate portion 14 is equally distributed by part. When the plurality of inner grooves is provided in the circular plate portion 14, angles between adjacent inner grooves 18 are configured to be the same to each other.

When a plurality of the inner grooves 18 is provided, the circular plate portion 14 is configured in a symmetrical shape even with a diameter at any angle as a center line.

Although each of the inner grooves 18 is shown in an elliptical shape in the present invention, the shape of the inner grooves 18 may be modified because the elliptical shape is just merely one embodiment for illustrative purpose only. Meanwhile, each of the inner grooves 18 is extended in a radial direction of the combustion gas suction hole 16 so as to make the area thereof become larger.

The protection covering 10 of the present invention as described above is installed to surround the outer portion of the folded tail fin 8 provided at the rear end of the projectile, thereby providing an effect to prevent the tail fin from being broken or damaged even at high pressure generated in the launching process of the projectile and is automatically separated from the projectile without providing any other mechanical structure immediately after the launch of the projectile, thereby providing an effect to allow the tail fin to be deployed quickly and economically.

Although the foregoing detailed description of the present invention has been presented with reference to the preferred embodiments of the present invention, those skilled in the art or those having ordinary knowledge in the technical field to which the present invention pertains will appreciate that various modifications, additions and substitutions are possible, without departing from the scope and spirit of the invention as disclosed in the accompanying claims.

What is claimed is:

1. A protection covering for folded tail fins of a projectile, the protection covering, for protecting the folded tail fins provided at a rear end of a projectile, comprising: a body portion having a cylindrical shape and having an inner part into which a portion of the projectile having tail fins installed thereat is inserted, wherein the tail fins are constrained; a circular plate portion provided at a rear end of the body portion to close the rear end of the body portion; and a combustion gas suction hole provided at a center of the circular plate portion so as to be coaxial with the circular plate portion, wherein the rear end of the projectile is configured open; a plurality of inner grooves each having a space corresponding to depth and width of each of the inner grooves is provided between the rear end of the projectile and each inner groove provided on the inner side surface of the circular plate portion of the protection covering; when the projectile is inserted into the body portion, the rear end of the projectile being open is closed by the circular plate portion, wherein the inner side of the rear end portion of the projectile becomes an air pocket; and after the projectile moves away from a gun barrel, the accumulated combustion gas flowed into the air pocket through the combustion gas suction hole during the launch of the projectile automatically separates the protection covering from the projectile by pressure applied on the inner side surface of the circular plate portion, wherein the plurality of inner grooves are provided in radial directions from the combustion gas suction hole on the inner side surface of the circular plate portion so as to increase an area of the inner side surface of the circular plate portion on which the pressure is applied in a direction to separate the protection covering.

2. The protection covering of claim 1, wherein, when the projectile is inserted into the body portion, the rear end of the projectile is positioned in close contact with the inner surface of the circular plate.

3. The protection covering of claim 1, the body portion includes a first end portion being a portion with a predetermined length from the rear end toward a front end of the body portion, a second end portion being a portion with a predetermined length from the first end portion toward the front end of the body portion, and a third end portion being a portion from the second end portion to the front end of the body portion.

4. The protection covering of claim 3, wherein an inner diameter of the body portion is constant within a range until reaching the third end portion starting from the first end portion of the body portion.

5. The protection covering of claim 3, wherein, in the body portion, the third end portion is configured to have a greater thickness than the first end portion.

6. The protection covering of claim 3, wherein the second end portion is configured such that a thickness thereof is gradually increased as approaching toward the third end portion from the first end portion.

7. The protection covering of claim 1, wherein the inner grooves are configured in a symmetrical shape.

8. The protection covering of claim 1, wherein, when the plurality of inner grooves is provided in the circular plate portion, angles between adjacent inner grooves are configured to be the same to each other.

9. The protection covering of claim 1, wherein each of the inner grooves is an elliptical shape.

* * * * *